US010803814B2

(12) United States Patent
Yoon et al.

(10) Patent No.: US 10,803,814 B2
(45) Date of Patent: Oct. 13, 2020

(54) DISPLAY APPARATUS USING BLIND PANEL

(71) Applicant: Korea Advanced Institute of Science And Technology, Daejeon (KR)

(72) Inventors: Jun-Bo Yoon, Daejeon (KR); Keun Seo Lim, Daejeon (KR)

(73) Assignee: KOREA ADVANCED INSTITUTE OF SCIENCE AND TECHNOLOGY, Daejeon (KR)

( * ) Notice: Subject to any disclaimer, the term of this patent is extended or adjusted under 35 U.S.C. 154(b) by 61 days.

(21) Appl. No.: 15/660,416

(22) Filed: Jul. 26, 2017

(65) Prior Publication Data

US 2018/0301096 A1 Oct. 18, 2018

(30) Foreign Application Priority Data

Apr. 18, 2017 (KR) ..... 10-2017-0049621

(51) Int. Cl.
*G09G 3/34* (2006.01)
*G09G 3/3208* (2016.01)

(52) U.S. Cl.
CPC ..... *G09G 3/346* (2013.01); *G09G 3/3208* (2013.01); *G09G 2300/023* (2013.01); *G09G 2320/066* (2013.01)

(58) Field of Classification Search
CPC ..... G09G 3/3208; G09G 3/346; G09G 2300/023; G09G 2320/066
See application file for complete search history.

(56) References Cited

U.S. PATENT DOCUMENTS 4,248,501 A * 2/1981 Simpson ..... G09F 9/372 359/227
5,638,084 A * 6/1997 Kalt ..... G09F 9/372 345/31
5,686,979 A * 11/1997 Weber ..... E06B 9/24 349/96
6,034,807 A * 3/2000 Little ..... G02B 26/02 345/108
6,057,814 A * 5/2000 Kalt ..... G02B 26/02 345/31
6,127,908 A * 10/2000 Bozler ..... B81B 3/0021 330/66
6,903,860 B2 * 6/2005 Ishii ..... G02B 26/0841 359/230
7,129,524 B2 * 10/2006 Lee ..... G09G 3/3233 257/59
7,304,783 B2 * 12/2007 Ishii ..... G02B 26/0841 359/290

(Continued)

*Primary Examiner* — Bryan Earles
(74) *Attorney, Agent, or Firm* — Foley & Lardner LLP

(57) ABSTRACT

A display apparatus may be provided that includes: a transparent display panel; a blind panel which is disposed adjacent to the transparent display panel and includes a plurality of cells that are individually drivable; and a controller which changes an operation mode through an on/off of the transparent display panel and a selective drive of a cell included in the blind panel. As a result, the display apparatus according to the embodiment of the present invention is a transparent display apparatus using the OLED. The display apparatus is able to operate without the external environmental constraints and to operate in various modes including the display function.

15 Claims, 25 Drawing Sheets

Transparent display Mode

(56) References Cited

U.S. PATENT DOCUMENTS

| | | | | |
|---|---|---|---|---|
| 7,768,595 | B2 * | 8/2010 | Chang | G02B 26/04 349/66 |
| 8,054,529 | B2 * | 11/2011 | Mehrl | G02B 26/0841 359/290 |
| 8,576,469 | B2 * | 11/2013 | Kim | G02B 5/005 359/230 |
| 8,692,762 | B2 * | 4/2014 | Chang | G02B 26/02 345/109 |
| 8,724,202 | B2 * | 5/2014 | Floyd | E06B 9/24 359/230 |
| 8,899,810 | B2 * | 12/2014 | Yee | G02B 26/004 362/602 |
| 8,994,715 | B2 * | 3/2015 | Song | H04N 13/0418 345/214 |
| 9,063,332 | B2 * | 6/2015 | Kim | G02B 1/116 |
| 2018/0224678 | A1 * | 8/2018 | Jung | G02F 1/137 |

* cited by examiner

Prior Art

Prior Art

| | Al | Ni | Pt |
|---|---|---|---|
| Average | 84.9% | 43.9% | 35.3% |

DISPLAY APPARATUS USING BLIND PANEL

CROSS REFERENCE TO RELATED APPLICATIONS

This application claims priority to Korean Application No. 10-2017-0049621, filed Apr. 18, 2017, the disclosure of which is herein incorporated by reference in its entirety.

BACKGROUND

Field

The present disclosure relates to a display apparatus using a blind panel, and more particularly to a display apparatus capable of selectively switching a transparent state and a reflective state.

Description of the Related Art

A transparent display is the most promising next generation display and has been being actively researched in accordance with the requirements of consumers in various fields. Recently, the transparent display is applied in a refrigerator door or department store showcase, etc. In this case, however, the transparent display employs a liquid crystal display (LCD), so that it can be restrictively used only within a controlled light source due to the characteristics of the LCD.

The most notable device for implementing the transparent display is a self-luminous organic light emitting diode (OLED). The OLED has advantages not only of emitting light itself but also of being transparentized, thinner and lighter. The OLED can be also used in a flexible substrate.

However, unlike the case where the OLED is applied to a standard TV or mobile device, there is a problem in implementing the transparent display apparatus using the OLED. FIGS. 1*a* and 1*b* are views for describing a problem of a conventional display apparatus using the OLED.

A typical OLED display instead of the transparent display apparatus reflects the light in a direction toward a user by disposing a metal mirror 12 on the opposite side of the user in order to improve the optical efficiency of the OLED emitting the light in both directions. Alternatively, the typical OLED display uses a metal plate 11 which allows the rear side of the display to completely blocking the light even when no matter how strong optical interference occurs on the opposite side of the user. Accordingly, there is no difficulty in transmitting information to the user through the OLED display. However, when the OLED is intended to be applied to the transparent display, it is not possible to use the metal plate 11 which blocks backlight as shown in FIG. 1*a* or to use the metal mirror 12 which reflects, as shown in FIG. 1*b*, the light to improve the optical efficiency. Eventually, when the current OLED is used in the transparent display, the OLED cannot be used in the outdoors with strong light or a place where multiple light sources exist.

SUMMARY

One embodiment is a display apparatus including: a transparent display panel; a blind panel which is disposed adjacent to the transparent display panel and includes a plurality of cells that are individually drivable; and a controller which changes an operation mode through an on/off of the transparent display panel and a selective drive of a cell included in the blind panel.

The cell may include a body which reflects or blocks light, and a driving part which controls a position of the body between angles of 0 to 90°.

The body may include a first body extending in a first direction and a second body extending and protruding in a second direction perpendicular to the first direction. The second direction may be a longitudinal direction in which the driving part extends.

The body may include a first body extending in a first direction and a second body more extending and protruding from the first body in the first direction. The second body may be non-overlapped with the driving part of another adjacent cell.

The body may have a hexagonal structure and the driving part may be connected to a vertex of the hexagonal structure.

The body may include a first body extending in a first direction and a second body extending and protruding in a second direction perpendicular to the first direction. The second body may extend and protrude from a position opposing the position to which the driving part is connected in the first body.

The plurality of the cells may be formed in the form of M×N (M and N are natural numbers).

The body of the plurality of the cells may be composed of a metal plate.

The transparent display panel is an OLED panel including a cathode layer, an organic matter layer, an anode layer, and a TFT backplane. The blind panel may be disposed adjacent to the TFT backplane.

The operation mode may include at least one of a window mode, a transparent display mode, a mirror mode, and a mirror display mode.

The controller may cause the transparent display panel to be turned off and cause parts of or the entire of the plurality of the cells of the blind panel to be turned off, so that the display apparatus may be operated in the window mode.

The controller may cause the transparent display panel to be turned on and cause parts of or the entire of the plurality of the cells of the blind panel to be turned off, so that the display apparatus may be operated in the transparent display mode.

The controller may cause the transparent display panel to be turned off and cause parts of or the entire of the plurality of the cells of the blind panel to be turned on, so that the display apparatus may be operated in the mirror mode.

The controller may cause the transparent display panel to be turned on and cause parts of or the entire of the plurality of the cells of the blind panel to be turned on, so that the display apparatus may be operated in the mirror display mode.

DETAILED DESCRIPTION

Figure 1A:
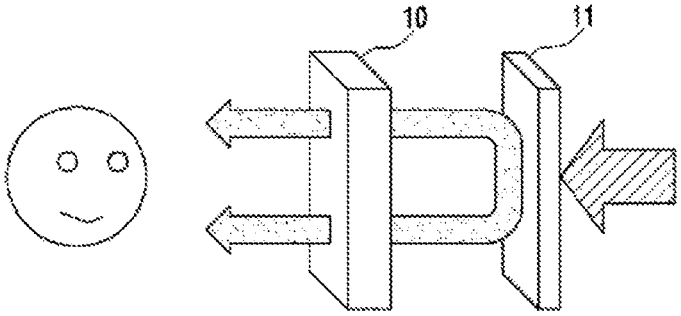
FIGS. 1*a* and 1*b* are views for describing problems of a conventional display apparatus using an OLED.
Figure 1B:
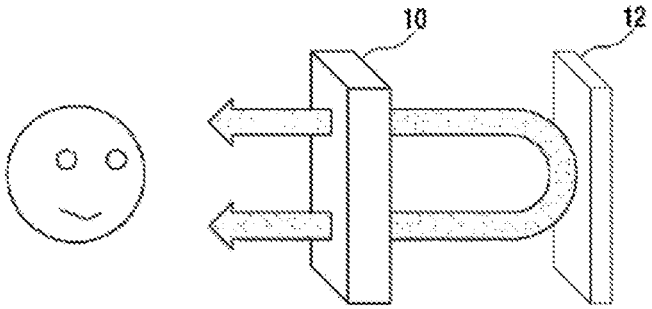

Specific embodiments of the present invention will be described in detail with reference to the accompanying drawings. The specific embodiments shown in the accompanying drawings will be described in enough detail that those skilled in the art are able to embody the present invention. Other embodiments other than the specific embodiments are mutually different, but do not have to be mutually exclusive. Additionally, it should be understood that the following detailed description is not intended to be limited.

The detailed descriptions of the specific embodiments shown in the accompanying drawings are intended to be read in connection with the accompanying drawings, which are to be considered part of the entire written description. Any reference to direction or orientation is merely intended for convenience of description and is not intended in any way to limit the scope of the present invention.

Specifically, relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation.

Figure 2A:
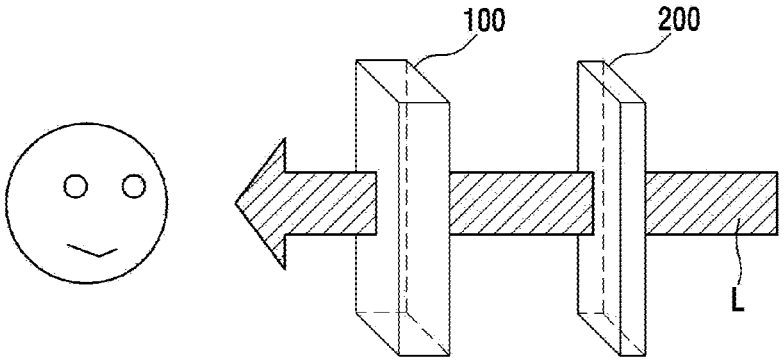
FIGS. 2*a* and 2*b* show a basic configuration of a display apparatus according to an embodiment of the present invention.
Figure 2B:
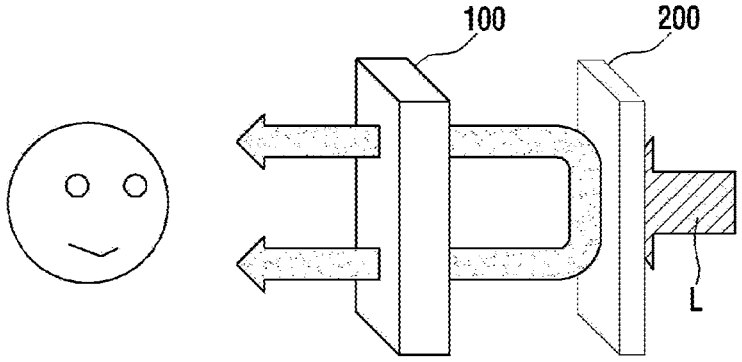

First, an operation method of a display apparatus according to an embodiment of the present invention will be described. FIGS. 2*a* and 2*b* show a basic configuration of the display apparatus according to the embodiment of the present invention. As shown in FIGS. 2*a* and 2*b*, the display apparatus includes a transparent display panel 100 and a blind panel 200.

The transparent display panel 100 is able to display information on a panel having a property of allowing the light to transmit therethrough. The transparent display panel 100 includes a light-transmissive display panel. An LCD or an OLED may be used in the light-transmissive display panel. However, here, the OLED has a transmittance much higher than that of the LCD because an organic semiconductor emits light by itself without a polarization plate, a color filter, a backlight, etc. Therefore, it is desirable that the display apparatus according to the embodiment of the present invention should use an OLED panel as the transparent display panel 100.

Figure 3A:
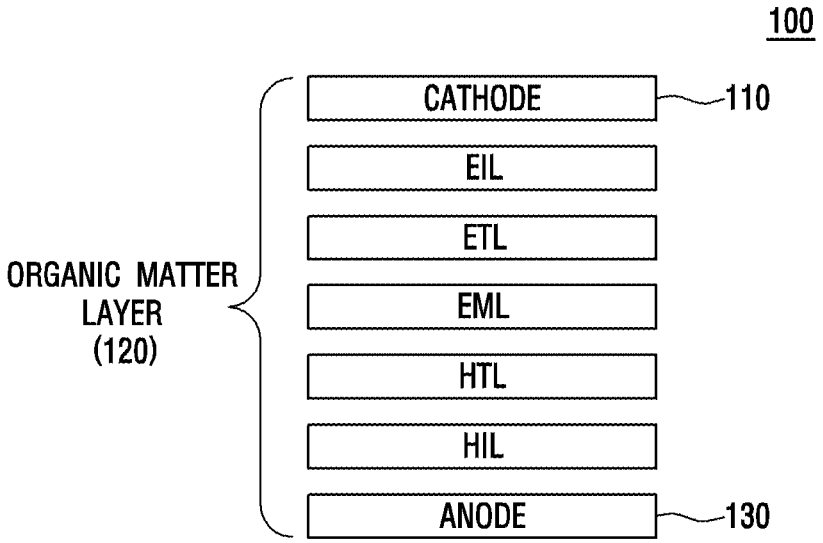
FIGS. 3*a* and 3*b* are views for describing a structure and operation of a transparent display panel according to the embodiment of the present invention.
Figure 3B:
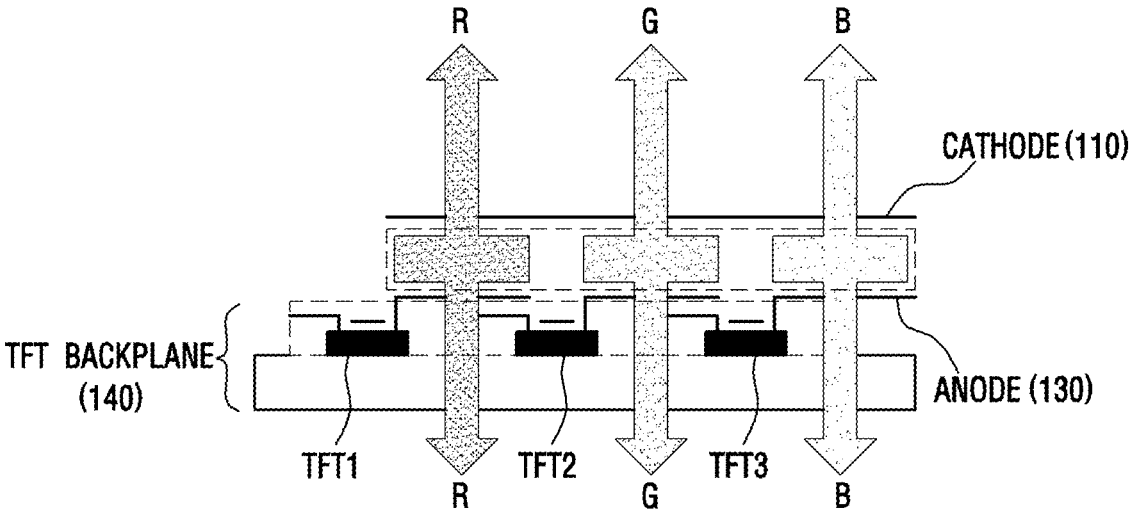

FIGS. 3*a* and 3*b* are views for describing a structure and operation of a transparent display panel implemented with the OLED.

According to operation characteristics of pixels constituting a pixel matrix, the OLED includes a line-driven passive-matrix organic light-emitting diode (PM-OLED) and an individual-driven active-matrix organic light-emitting diode (AM-OLED). None of them require a backlight. Therefore, the OLED enables a very thin display module to be implemented, has a constant contrast ratio according to an angle and obtains a good color reproductivity depending on a temperature. Also, it is very economical in that non-driven pixel does not consume power.

In terms of operation, the PM-OLED emits light only during a scanning time at a high current, and the AM-OLED maintains a light emitting state only during a frame time at a low current. Therefore, the AM-OLED has a resolution higher than that of the PM-OLED and is advantageous for driving a large area display panel and consumes low power. Also, a thin film transistor (TFT) is embedded in the AM-OLED, and thus, each component can be individually controlled, so that it is easy to implement a delicate screen.

In the embodiment of the present invention, the AM-LED having a more excellent function will be described. As shown in FIG. 3*a* of FIGS. 3*a* and 3*b*, the OLED is basically composed of an anode 130, an organic matter layer 120, and a cathode 110. The organic layer 280 may include a hole injection layer (HIL), a hole transport layer (HTL), an electron injection layer (EIL), an electron transport layer (ETL), and an light-emitting layer (EML).

Briefly describing each of the layer constituting the organic matter layer 120, the HIL functions to inject electron holes and is made of a material such as CuPc, etc. The HTL functions to transfer the injected electron holes, and the electron hole must have a good mobility. Arylamine TPD, or the like may be used as the HTL. The EIL and ETL inject and transport electrons. The injected electrons and electron holes are combined in the EML and emit light. The EML represents the color of the emitted light and is composed of a host determining the lifespan of the organic matter and an impurity (dopant) determining the color sense and efficiency.

As shown in FIG. 3*b*, the OLED panel is composed of a thin film transistor backplane (TFT) backplane 140, the anode 130, the organic matter layer, and the cathode 110. Regarding an RGB type AM-OLED panel among various types of AM-OLED panels, one pixel is composed of three primary colors (Red, Green, and Blue) and determines the color of the light.

As shown in FIG. 3*b*, when the organic matter layer is inserted between the anode 130 and the cathode 110 and the TFT becomes an on-state, a driving current is applied to the anode and the electron holes are injected, and the electrons are injected to the cathode. Then, the electron holes and electrons move to the organic layer and meet each other and then emit the light (L).

Up to now, the transparent display panel has been assumed to be the AM-OLED panel. However, without being limited to this, the transparent display panel 100 can be implemented by the PM-OLED or other types of panels.

Referring back to FIGS. 2*a* and 2*b*, the blind panel 200 is provided in the back side (on the basis of the user's viewing direction) of the above-described transparent display panel 100. That is, the blind panel 200 may be located adjacent to the TFT backplane 140 of FIG. 3*b*.

The blind panel 200 may include a plurality of cells capable of controlling the transmittance of the light (L). Such a plurality of the cells may be arranged in the form of an array. The blind panel 200 may be composed of a plurality of micro shutter arrays and may be manufactured by using MEMS technology.

Figure 4:
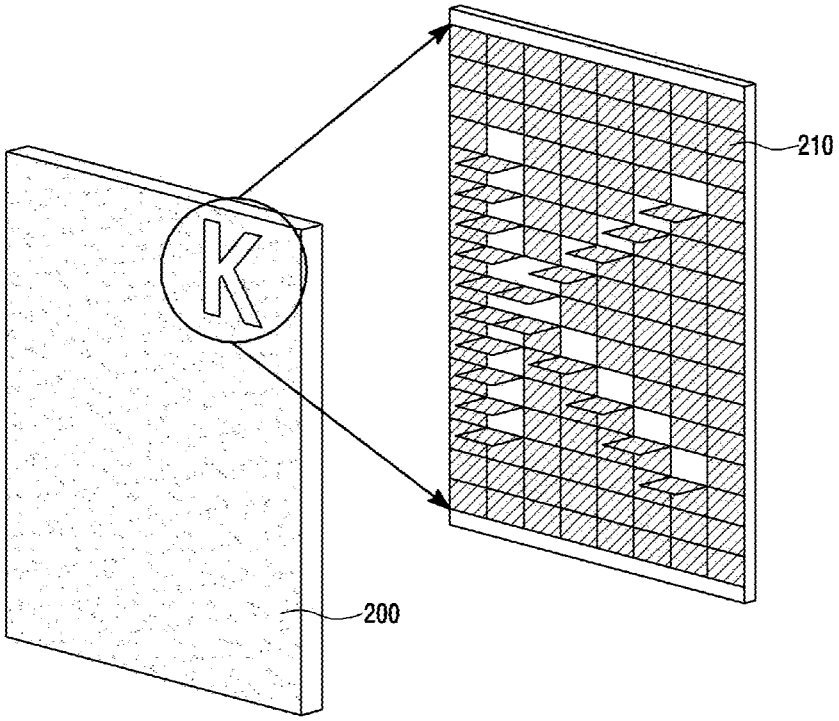
FIG. 4 shows a blind panel which is used in the display apparatus according to the embodiment of the present invention.

FIG. 4 shows the blind panel 200 which is used in the display apparatus according to the embodiment of the present invention. The blind panel 200 may be implemented by the micro shutter array which can be selectively driven. In other words, the blind panel 200 may include a plurality of micro shutters composed of an M×N array (M and N are natural numbers). Each micro shutter cell 210 rotates about a fixed end at an angle of between 0 to 90°, thereby allowing the light (L) to selectively transmit and controlling the transmittance of the light (L). Meanwhile, in a case where a body of the micro shutter is made of a metal mirror plate, when the body becomes an on-state, the body is able to function as a mirror.

In the display apparatus according to the embodiment of the present invention, a transparent/reflective state of only the desired micro shutter cell 210 can be selectively switched by a controller (not shown) in accordance with a drive addressing method. Since the blind panel 200 is manufactured by MEMS technology, it has a rapid operating speed, an excellent contrast ratio, a high opening ratio, and broadband reflection characteristics.

The blind panel 200 can be manufactured in various ways and forms by using publicly-known technologies. For convenience of understanding, the structure and operation of the micro shutter cell 210 constituting the blind panel 200 will be briefly described with reference to FIGS. 5*a* and 5*b*.

Figure 5A:
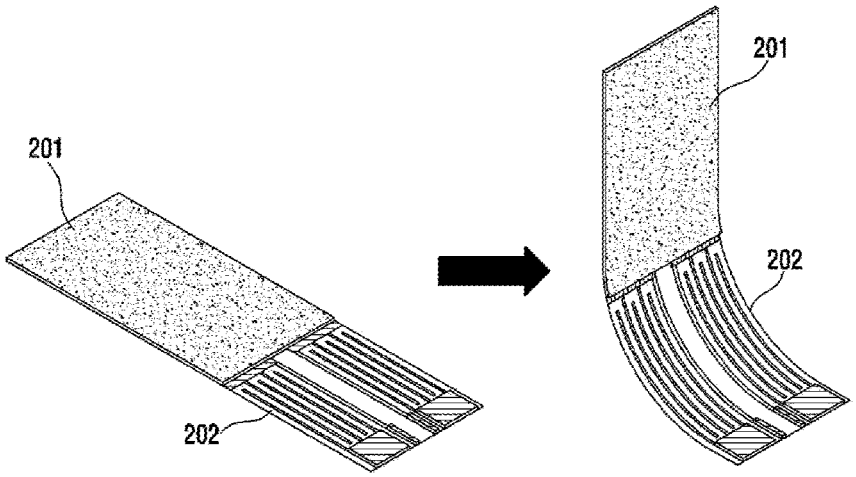
FIG. 5*a* shows an example of a micro shutter cell constituting the blind panel according to the embodiment of the present invention.

FIG. 5*a* shows an example of the micro shutter cell 210 constituting the blind panel 200 according to the embodiment of the present invention.

The micro shutter cell 210 shown in FIG. 5*a* includes a body 201 and a driving part 202. The body 201 functions to reflect or block the light. Specifically, the body 201 may reflect the light emitted from the display panel 100 or may block the light entering from the outside of the display apparatus.

The driving part 202 may be composed of an upper portion and a lower portion. The upper portion may be configured to have a compressive stress, and the lower portion may be configured to have a tensile stress. Also, it is desirable that the thermal expansion coefficient of the upper portion should be greater than that of the lower portion. For example, the upper portion may be configured to include Au and the lower portion may be configured to include $SiO_2$. However, there is no limitation to this.

Due to the compressive stress of the upper portion and the tensile stress of the lower portion, the driving part 202 has an upwardly bent shape.

When heat is generated in the driving part 202, thermal expansion occurs. Here, since the thermal expansion coefficient of the upper portion is greater than that of the lower portion, the upper portion has a larger length change than that of the lower portion. Therefore, the driving part 202 bent upwardly in an initial state is straightened by the thermal expansion. As such, the driving part 202 has an angle displacement in the straightening direction in the initial state. Accordingly, the driving part 202 enables the position movement of the body 201 between angles of 0 to 90°.

When the controller (not shown) applies a current to a specific micro shutter cell 210, heat is generated in the driving part 202 by the applied current. The generated heat causes the thermal expansion of the driving part 202, so that the driving part 202 is straightened. Due to the action of the driving part 202, the position of the shutter 201 is moved.

Subsequently, the current which is applied to the driving part 202 is interrupted, the heat applied to the driving part 202 disappears. Here, the thermally expanded upper and lower portions have a restoring force at which they return to their initial state. Due to the restoring force, the upper and lower portions return to their original initial state.

The controller of the display apparatus according to the embodiment of the present invention controls voltage that is applied to each micro shutter cell 210, thereby controlling the on/off of the blind panel 200.

Figure 5B:
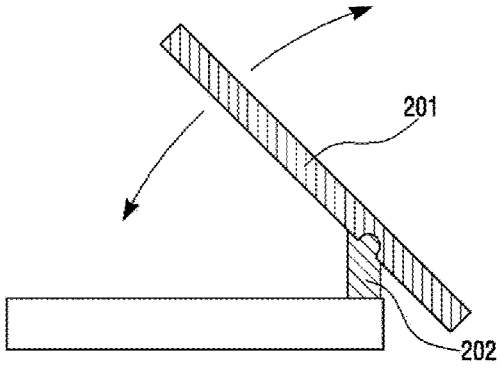
FIG. 5*b* shows another example of the micro shutter cell constituting the blind panel according to the embodiment of the present invention.

FIG. 5*b* shows another example of the micro shutter cell 210 constituting the blind panel 200 according to the embodiment of the present invention. The micro shutter cell 210 shown in FIG. 5*b* includes the body 201 and the driving part 202.

The controller (not shown) controls the position of the body 201 by controlling voltage that is applied to the driving part 202. That is, when a voltage is applied to a specific micro shutter cell 210, the driving part 202 rotates the body 201 about a fixed end. In this way, the driving part 202 controls individually all of the micro shutter cells 210, and thus, controls the on/off of the blind panel 200. Meanwhile, the rotation angle of the body 201 can be changed by controlling the magnitude of the voltage, etc. Thus, the transmittance of the micro shutter cell 210 can be controlled.

Figure 5C:
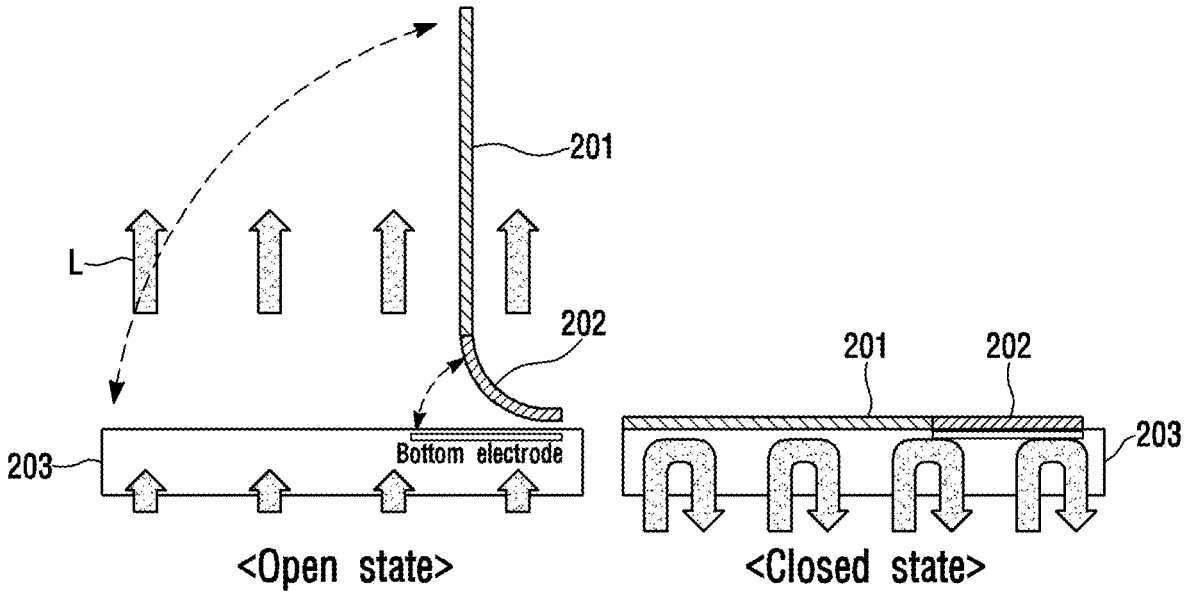
FIG. 5*c* shows further another example of the micro shutter cell constituting the blind panel according to the embodiment of the present invention.

FIG. 5*c* shows further another example of the micro shutter cell constituting the blind panel according to the embodiment of the present invention. The micro shutter cell 210 shown in FIG. 5*c* includes the body 201 and the driving part 202.

The driving part 202 becomes in an open state (see the figure on the left of FIG. 5*c*) unless the voltage is applied from a bottom electrode. In other words, when the controller (not shown) opens the micro shutter cell 210, no voltage is applied, so that the micro shutter cell 210 maintains the open state.

Here, when the controller (not shown) applies the voltage through the bottom electrode of the driving part 202, the body 201 is bonded to a substrate 203 and becomes in a closed state (see the figure on the right of FIG. 5*c*). More specifically, the body 201 interacts electromagnetically with the bottom electrode, so that the body 201 moves toward the substrate 203 by an electromagnetic force.

Figure 5D:
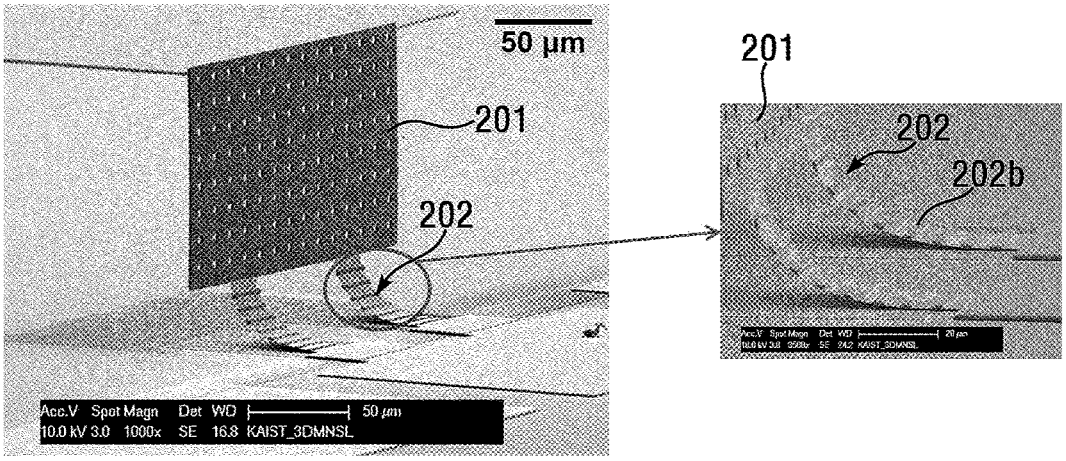
FIG. 5*d* shows an actually implemented example of the micro shutter cell constituting the blind panel according to the embodiment of the present invention.

FIG. 5*d* shows an actually implemented example of the micro shutter cell constituting the blind panel according to the embodiment of the present invention. The operation method is the same as that of FIG. 5*c*. Here, in the implemented example of FIG. 5*d*, a contact prevention member 202*b* is further provided in the body 201. The contact prevention member 202*b* may be made of a conductive material or an insulating material. The contact prevention member 202*b* protrudes toward the electrode and prevents the body 201 from contact the bottom electrode, an insulation layer (not shown), etc. While FIG. 5*d* shows that the contact prevention member 202*b* has a ⊏-shape, the contact prevention member 202*b* may have a different shape from this in another embodiment. Also, in another embodiment, the contact prevention member 202*b* may be omitted.

The micro shutter cells 210 shown in FIGS. 5*a* to 5*d* are individually selectively controlled by the controller (not shown). To put it another way, although all of the plurality of the micro shutter cells 210 may be turned on/off at the same time, the micro shutter cells 210 are individually controlled, so that only the micro shutter cell 210 of a specific area or a particular pattern may be turned on or off.

FIGS. 5*a* to 5*d* simply show one embodiment for implementing the micro shutter cell 210. It will be apparent to those skilled in the art that the micro shutter cell 210 can be implemented by various methods other than this.

Hereafter, the shape of the micro shutter cell constituting the blind panel according to the embodiment of the present invention will be described with reference to FIGS. 6*a* to 6*f*.

Figure 6A:
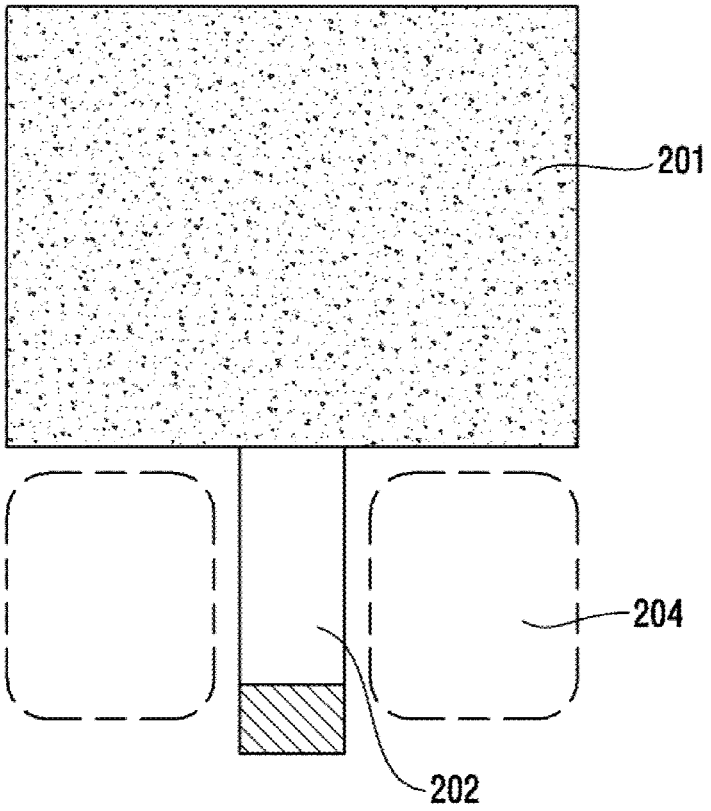
FIG. 6*a* shows a dead area of the micro shutter cell.
Figure 6B:
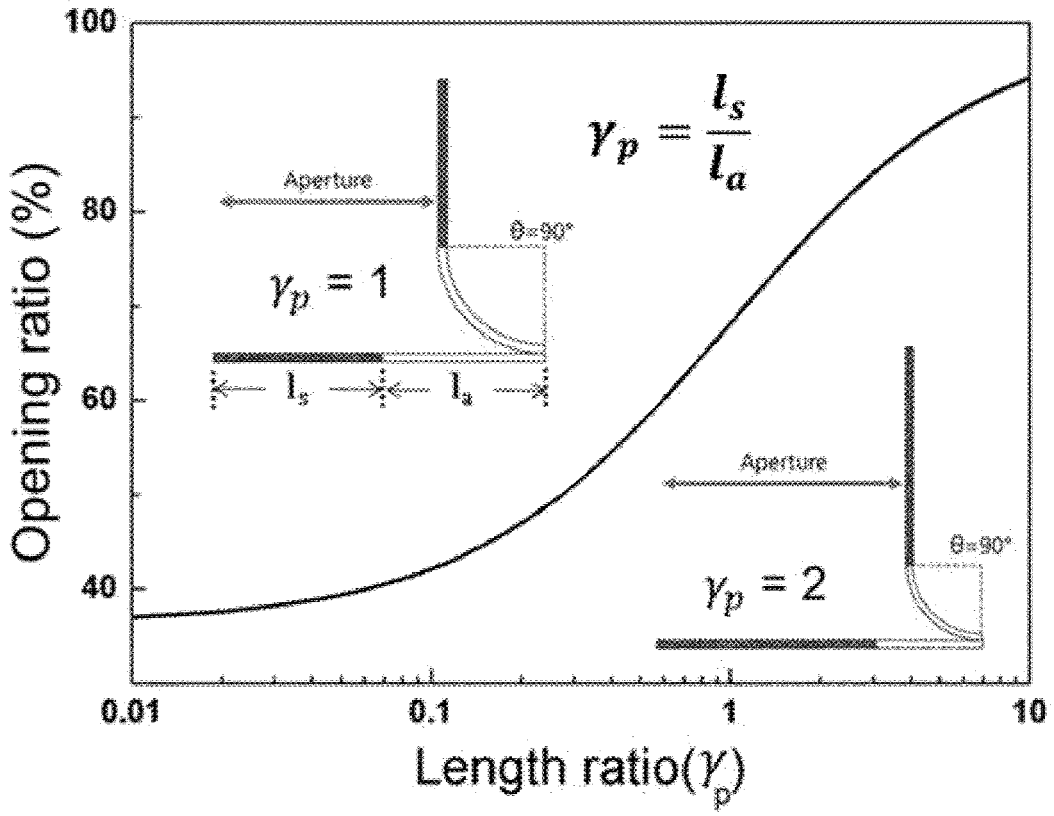
FIG. 6*b* is a graph showing an opening ratio according to a length ratio between a shutter part and a driving part.

FIG. 6*a* shows a dead area of the micro shutter cell. FIG. 6*b* is a graph showing an opening ratio according to a length ratio between the shutter part and the driving part.

Referring to FIG. 6*a*, a dead area 204 is formed depending on the heights and areas of the body 201 and the driving part 202 included in the micro shutter cell 210.

The dead area 204 cannot completely reflect or block the light and needs to be reduced.

The opening ratio of the micro shutter cell 210 is determined by a length ratio of the heights of the body 201 and the driving part 202. Referring to FIG. 6*b*, there is a limit to increase the opening ratio depending on the length ratio of the heights of the body 201 and the driving part 202. That is, the body 201 has to have a very wide area in order to form the opening ratio of greater than 80%. When the body 201 becomes excessively larger, the driving part 202 may not be able to completely support the body 201.

Therefore, in order to increase the opening ratio, not only the length ratio of the heights of the body 201 and the driving part 202 is increased, but also the dead area 204 needs to be reduced to the maximum.

Figure 6C:
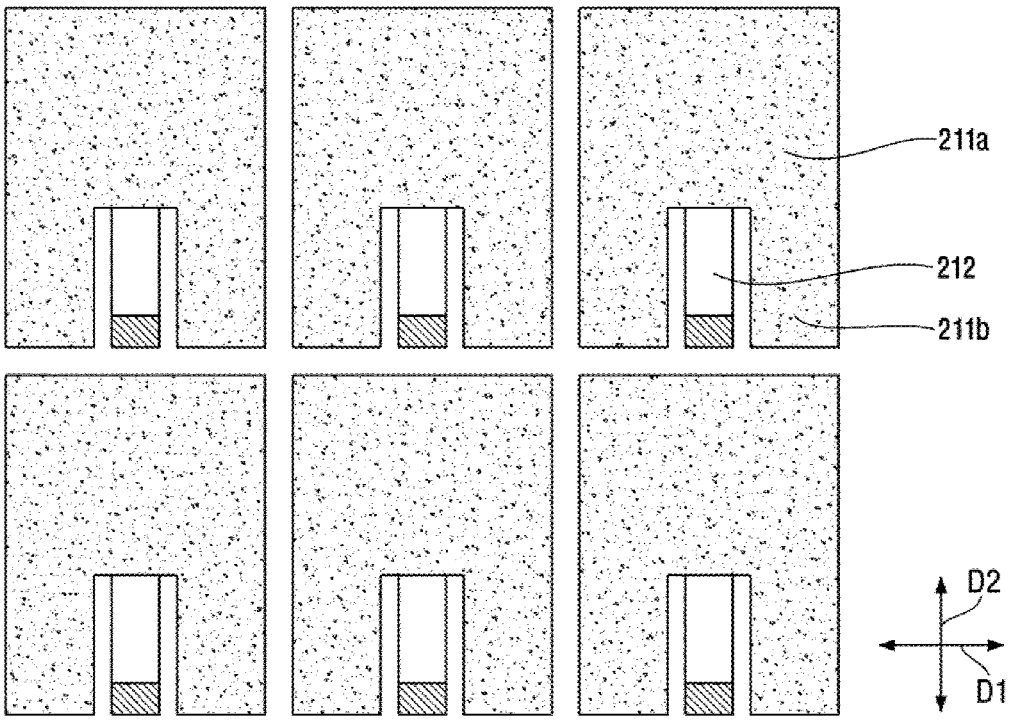
FIG. 6*c* shows schematically the shape of the micro shutter cell constituting the blind panel according to the embodiment of the present invention.

FIG. 6*c* shows schematically the shape of the micro shutter cell constituting the blind panel according to the embodiment of the present invention.

Referring to FIG. 6*c*, the micro shutter cell 210 constituting the blind panel according to the embodiment of the present invention includes a body 211 including a first body 211*a* and a second body 211*b*, and a driving part 212.

The body 211 includes the first body 211*a* extending in a first direction D1 and the second body 211*b* extending and protruding from the first body 211*a* in a second direction D2 perpendicular to the first direction D1. Particularly, the second direction D2 is a longitudinal direction in which the driving part 212 extends.

The second body 211*b* extends and protrudes downward from the first body 211*a*. This is a structure for maximally covering remaining areas other than the area where the driving part 212 has been formed.

Figure 6D:
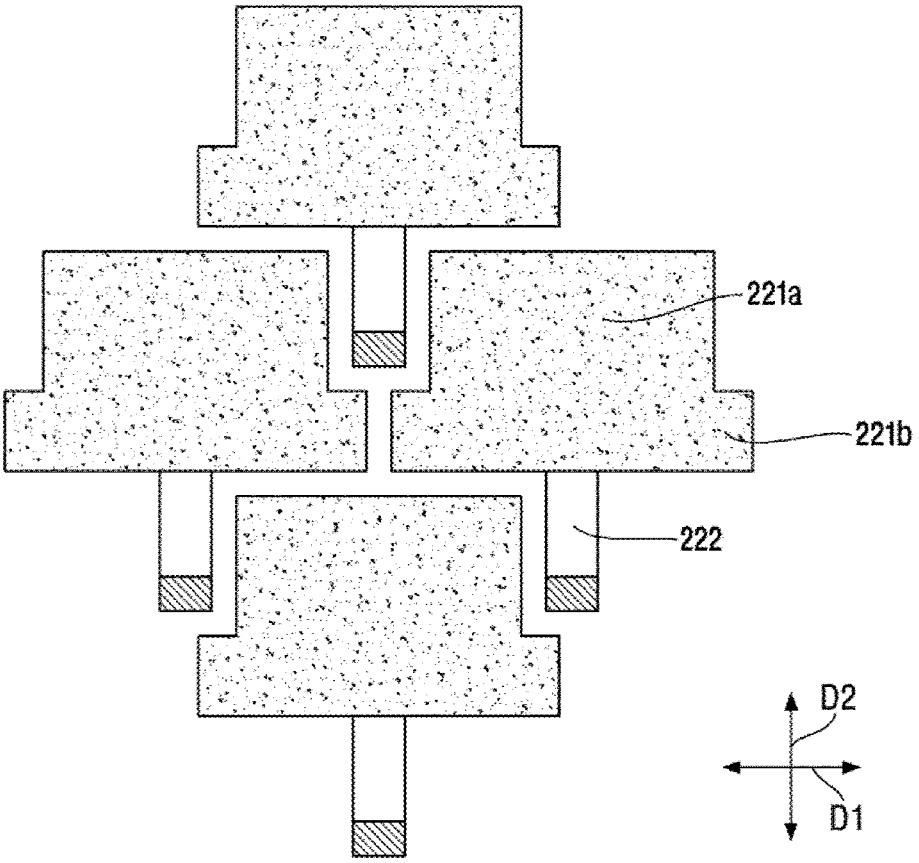
FIG. 6*d* shows schematically the shape of the micro shutter cell constituting the blind panel according to another embodiment of the present invention.

FIG. 6*d* shows schematically the shape of the micro shutter cell constituting the blind panel according to another embodiment of the present invention.

Referring to FIG. 6*d*, the micro shutter cell 210 constituting the blind panel according to another embodiment of the present invention includes a body 221 including a first body 221*a* and a second body 221*b*, and a driving part 222.

The body 221 includes the first body 221*a* extending in the first direction D1 and the second body 221*b* further extending and protruding from the first body 221*a* in the first direction D1. Here, the second body 221*b* is disposed to be non-overlapped with the driving part 222 of another adjacent cell.

This is a structure in which the dead area 204 resulting from that the height of the body 221 is greater than that of the driving part 222 is covered by means of a symmetrical wing structure (i.e., the second body 221*b*). Through the design of the micro shutter cell 210 shown in FIG. 6*d*, the blind panel 200 including the micro shutter cell 210 having a high opening ratio of greater than 90% can be formed.

Figure 6E:
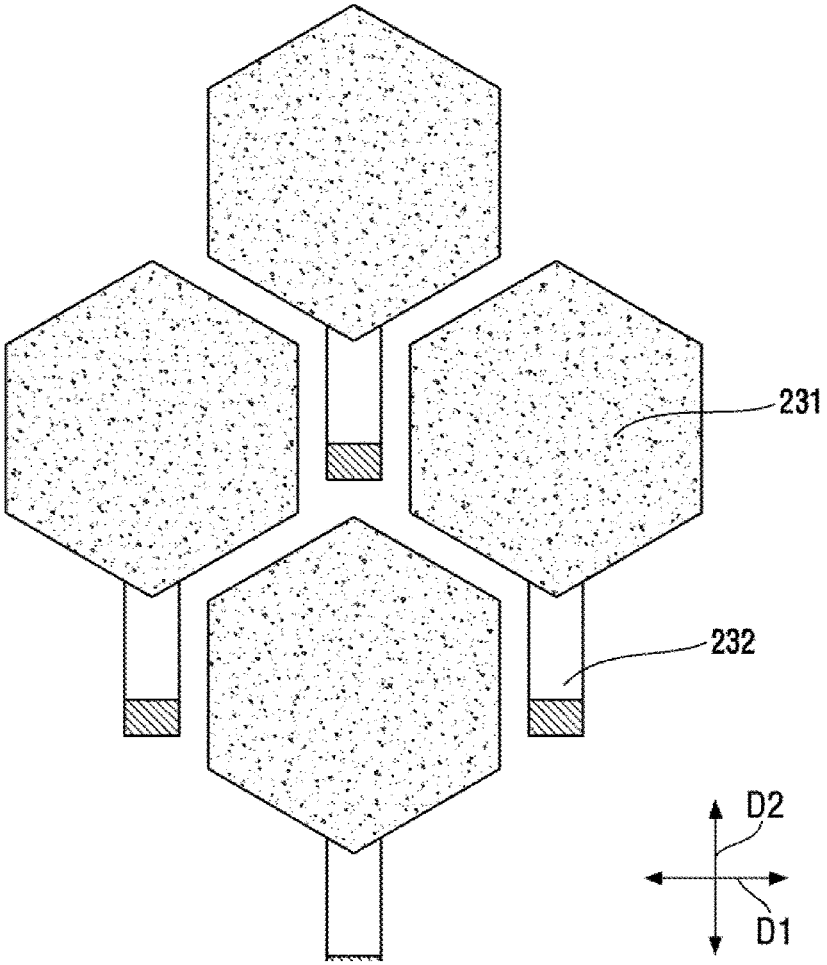
FIG. 6*e* shows schematically the shape of the micro shutter cell constituting the blind panel according to further another embodiment of the present invention.

FIG. 6*e* shows schematically the shape of the micro shutter cell constituting the blind panel according to further another embodiment of the present invention.

Referring to FIG. 6*e*, the micro shutter cell 210 constituting the blind panel according to further another embodiment of the present invention includes a body 231 and a driving part 232.

The body 231 has a hexagonal structure, and the driving part 232 is connected to the vertex of the hexagonal structure of the body 231.

Depending on the hexagonal structural shape of the body 231, the array may be formed in the form of a honeycomb structure as a whole. This is an embodiment capable of covering the dead area 204.

Figure 6F:
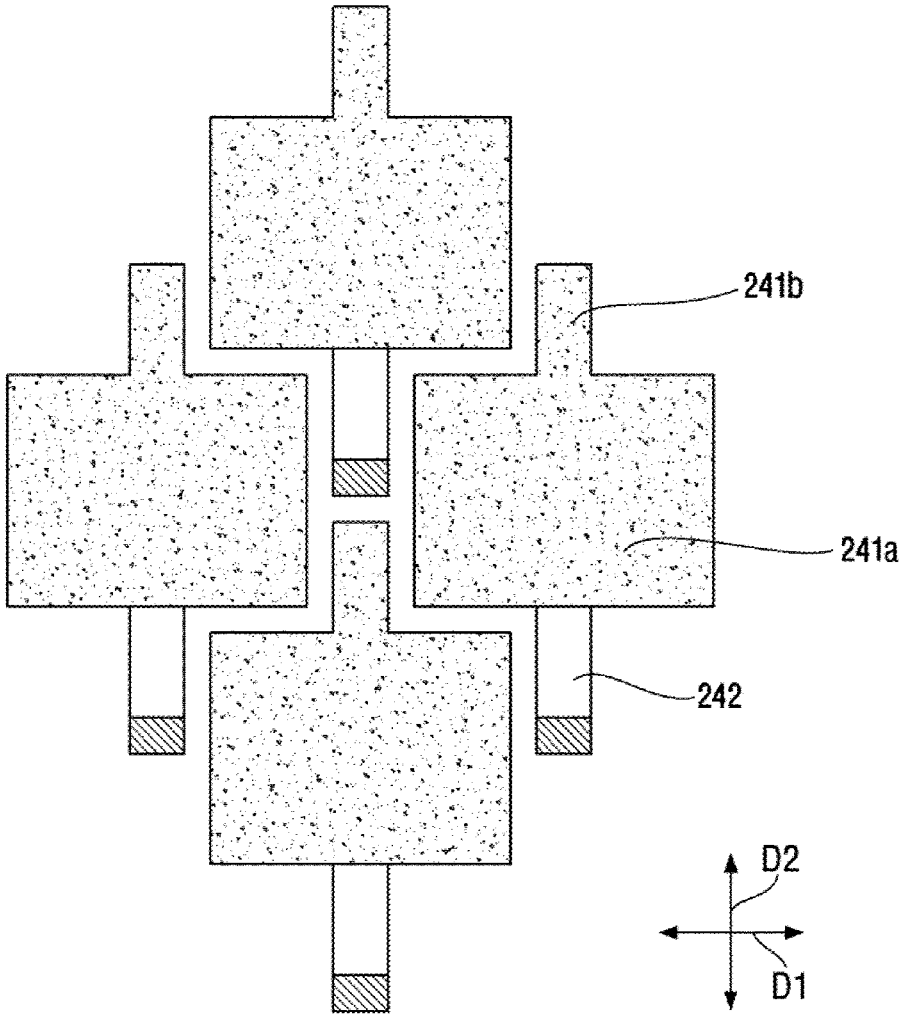
FIG. 6*f* shows schematically the shape of the micro shutter cell constituting the blind panel according to yet another embodiment of the present invention.

FIG. 6*f* shows schematically the shape of the micro shutter cell constituting the blind panel according to yet another embodiment of the present invention.

Referring to FIG. 6*f*, the micro shutter cell 210 constituting the blind panel according to yet another embodiment of the present invention includes a body 241 including a first body 241*a* and a second body 241*b*, and a driving part 242.

The body 241 includes the first body 241*a* extending in the first direction D1 and the second body 241*b* extending and protruding from the first body 241*a* in the second direction D2 perpendicular to the first direction D1. Here, the second body 241*b* extends and protrudes from a position opposing the position to which the driving part 242 is connected in the first body 241*a*.

Here, the second direction D2 is a longitudinal direction in which the driving part 242 extends.

The second body 241*b* extends and protrudes upward from the first body 241*a*. This is a structure for maximally covering remaining area other than the area where the driving part 242 of another adjacent micro shutter cell has been formed.

Figure 6G:
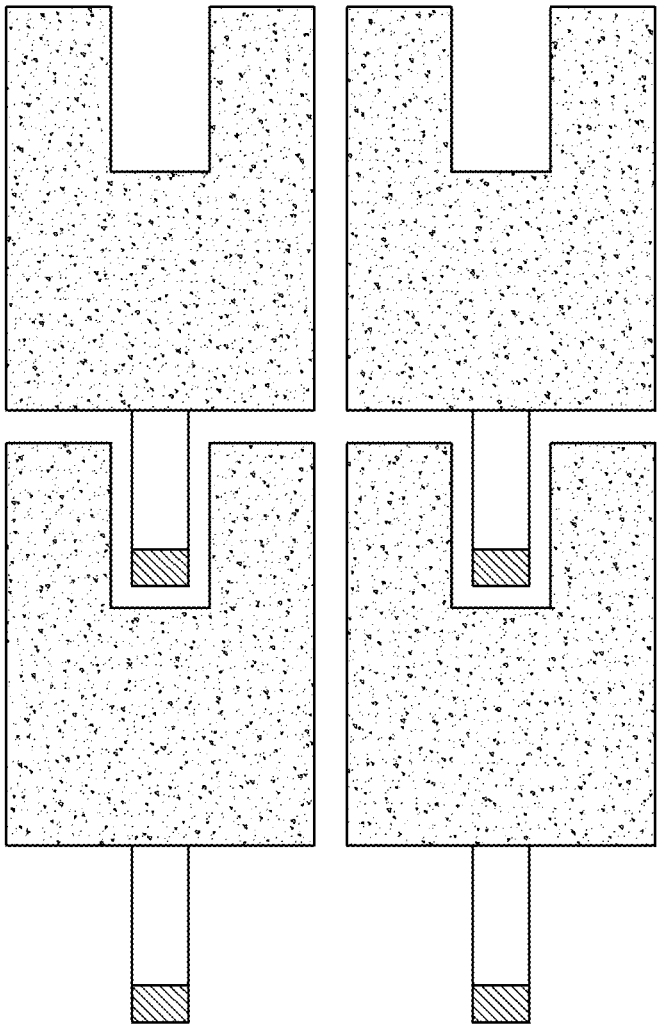
FIGS. 6*g* and 6*h* show schematically the shape of the micro shutter cell constituting the blind panel according to still another embodiment of the present invention.
Figure 6H:
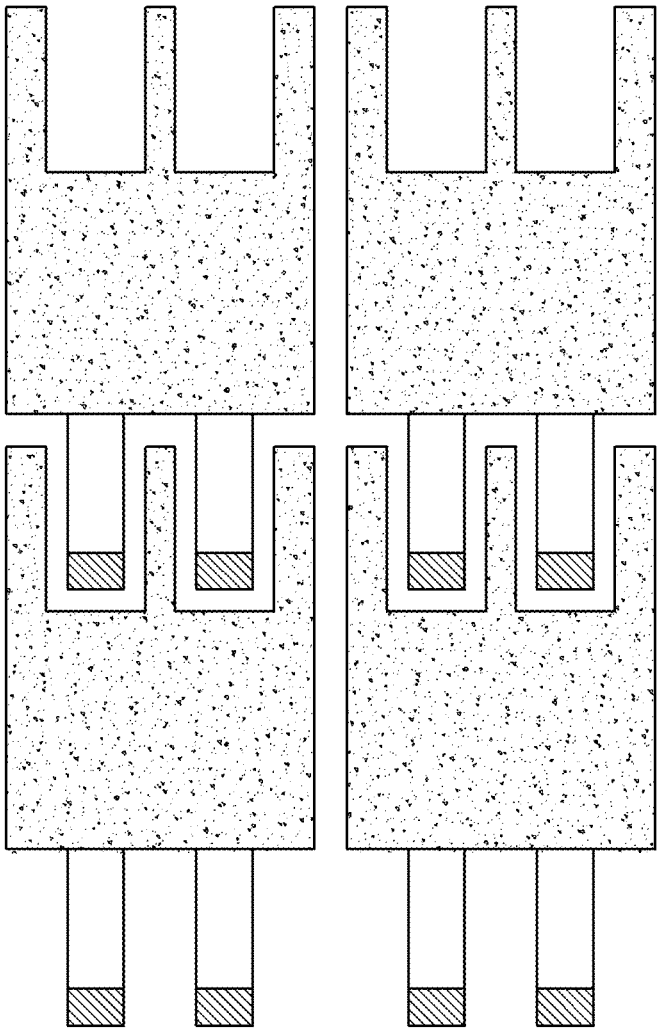

FIGS. 6*g* and 6*h* show schematically the shape of the micro shutter cell constituting the blind panel according to still another embodiment of the present invention.

The shape of the micro shutter cell shown in FIGS. 6*g* and 6*h* is shown as one embodiment to maximally cover remaining area other than the area where the driving part of another adjacent micro shutter cell has been formed.

It will be apparent to those skilled in the art that the micro shutter cell 210 can be implemented by various methods through the application of such a structure.

Referring back to FIGS. 2*a* and 2*b*, the on/off of the transparent display panel 100 and the blind panel 200 can be controlled by the method described above.

When the transparent display panel 100 and the blind panel 200 are all in an off-state, the transparent display panel 100 and the blind panel 200 operate in a window mode shown in FIG. 2*a* because the transparent display panel 100 allows the light (L) to transmit therethrough as it is and the blind panel 200 allows the light (L) to transmit therethrough as it is. The window mode means that the transparent display panel 100 and the blind panel 200 operate like a window in a transparent state because they are all transparent.

Meanwhile, when the transparent display panel 100 and the blind panel 200 are all in an on-state, the transparent display panel 100 emits the light by itself and displays information. Here, since the blind panel 200 is also in an on-state, and thus, blocks the light (L) entering from the outside, the blind panel 200 assists the transparent display panel 100 to function as the display apparatus. In other words, since the blind panel 200 in the state of FIG. 2*b* functions as the metal plate 11 of FIG. 1*a*, the blind panel 200 operates in a transparent display mode. The transparent display mode means that the display apparatus according to the embodiment of the present invention operates as a display using the OLED panel.

Also, when the on/off of the micro shutter cell 210 provided in the blind panel 200 is selectively controlled, backlight is blocked only in the area of the blind panel 200, which corresponds to the micro shutter cell 210 in an on-state. Therefore, the efficiency and visibility of the display panel 100 in the corresponding area can be improved. Likewise, when the on/off of the micro shutter cell 210 provided in the blind panel 200 is selectively controlled, only the area of the blind panel 200, which corresponds to the micro shutter cell 210 in an on-state, is able to function as a mirror.

Figure 7:
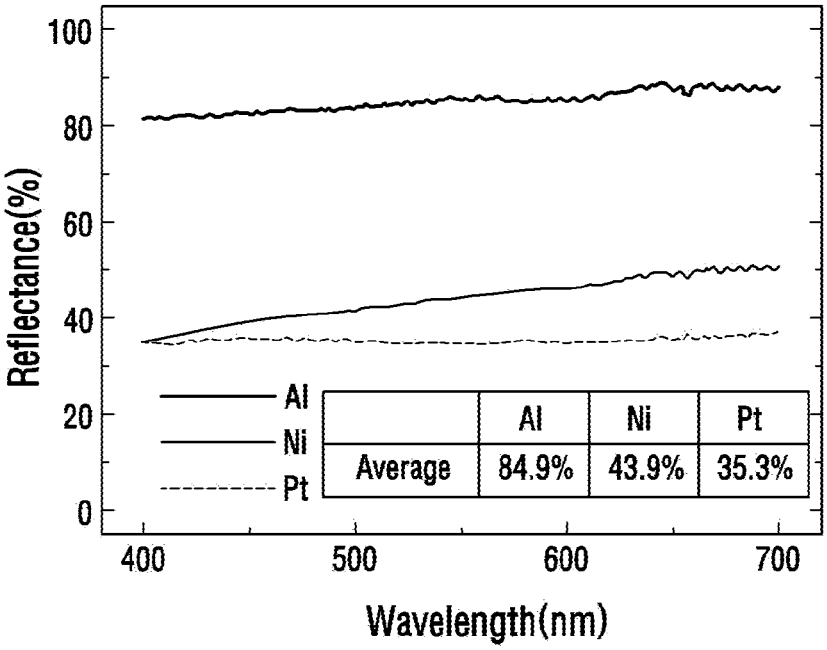
FIG. 7 is a graph showing a reflectance according to a wave length of a body which constitutes the micro shutter cell constituting the blind panel according to the embodiment of the present invention.

FIG. 7 is a graph showing a reflectance according to a wave length of the body 201 which constitutes the micro shutter cell 210 constituting the blind panel 200 according to the embodiment of the present invention. The horizontal axis in the graph of FIG. 7 represents a wavelength, and the vertical axis represents a reflectance. The body 201 may be made of a metal plate such as Al, Ni, Pt, etc., and may hereby be able to function as a mirror. FIG. 7 shows the reflectance when Al, Ni, and Pt are used.

Referring to FIG. 7, it can be seen that, unlike a cholesteric liquid crystal, the blind panel 200 according to the embodiment of the present invention shows a very uniform reflection distribution with respect to the wavelength. This means that not only natural light but also the light of the display panel, which is implemented in RGB, can be all reflected by using single blind panel 200.

Figure 8:
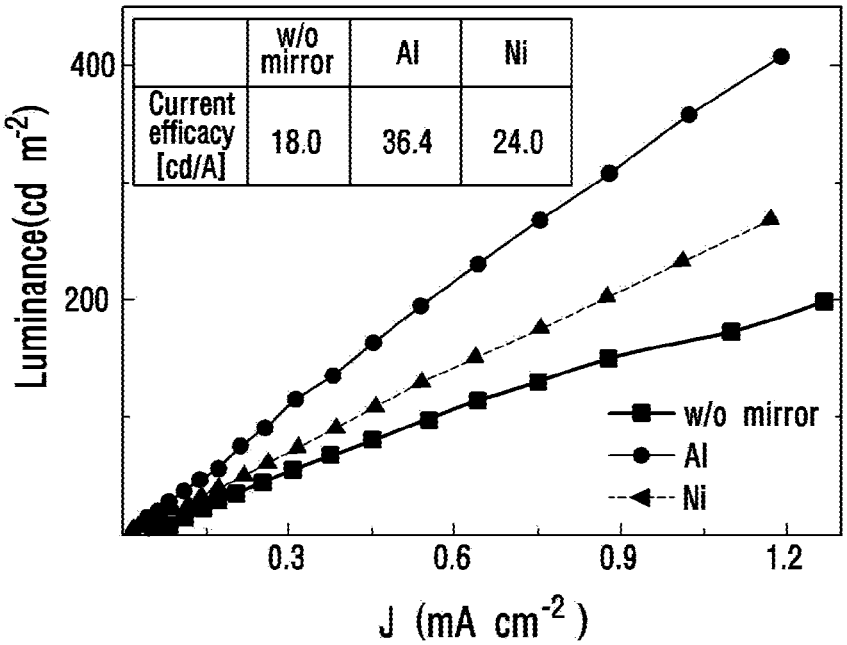
FIG. 8 is a graph showing a comparison of an optical efficiency of a case where an Al metal plate and a Ni metal plate are positioned behind an OLED panel with an optical efficiency of a case where nothing is positioned.

FIG. 8 is a graph showing a comparison of the optical efficiency of a case where the Al metal plate and the Ni metal plate are positioned behind the OLED panel with the optical efficiency of a case where nothing is positioned. Referring to FIG. 8, it is to be understood that the optical efficiency is improved by about 133% due to the existence of the Al metal plate and the optical efficiency is improved by about 200% due to the existence of the Ni metal plate. Therefore, the blind panel 200 made of the metal plate such as Al, Ni, Pt, etc., is used, so that the optical efficiency can be improved and the performance of the display apparatus using the OLED can be improved.

FIGS. 9*a* to 9*d* show various operation modes of the display apparatus according to the embodiment of the present invention. The display apparatus according to the embodiment of the present invention includes the transparent display panel 100 and the blind panel 200 which is disposed adjacent to the transparent display panel 100 and includes the plurality of the micro shutters that can be individually driven. Also, the controller (not shown) may change the operation mode by individually controlling the on/off of the transparent display panel 100 and the blind panel 200.

As described above, the plurality of the micro shutter cells 210 provided in the blind panel 200 includes the body 201 and the driving part 202. The driving part 202 may control the position of the body 201 between angles of 0 to 90°, and the plurality of the micro shutter cells 210 are, as shown in FIG. 4, composed of an M×N array (M and N are natural numbers). Meanwhile, when the blind panel 200 is in an on-state, that is to say, when the bodies 201 of all of the micro shutter cells 210 are positioned in parallel with the transparent display panel 100, the body 201 functions as a mirror. The plurality of the micro shutter cells may be made of the metal plate such that the light emitted from the display panel 100 is efficiently reflected. The display apparatus according to the embodiment of the present invention may operate in various modes, and the operation mode includes any one of a window mode, a transparent display mode, a mirror mode, and a mirror display mode.

Figure 9A:
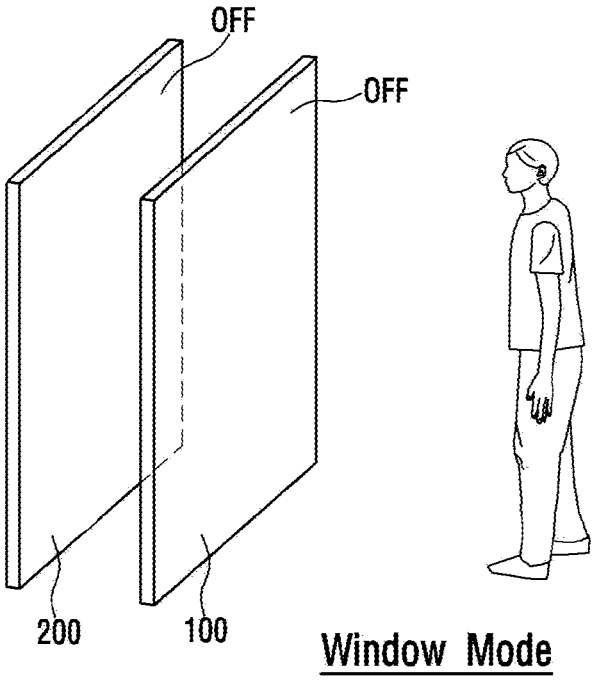
FIG. 9*a* shows a first operation mode of the display apparatus according to the embodiment of the present invention.

FIG. 9*a* shows that the display apparatus according to the embodiment of the present invention operates in the window mode. In FIG. 9*a*, the display panel 100 and the blind panel 200 are all in an off-state. Since the display panel 100 is in an off-state, the display panel 100 does not display any information and does not emit light. Therefore, the display panel 100 exists as a transparent panel. Since the blind panel 200 is also in an off-state, that is to say, all of the micro shutter cells 210 are arranged in a direction perpendicular to the display panel 100, the blind panel 200 exists as a transparent panel. Eventually, the display apparatus in the window mode is nothing but a transparent panel like a window, so that the user is able to see an object behind the display apparatus in the window mode or to enjoy the scenery behind the display apparatus.

Figure 9B:
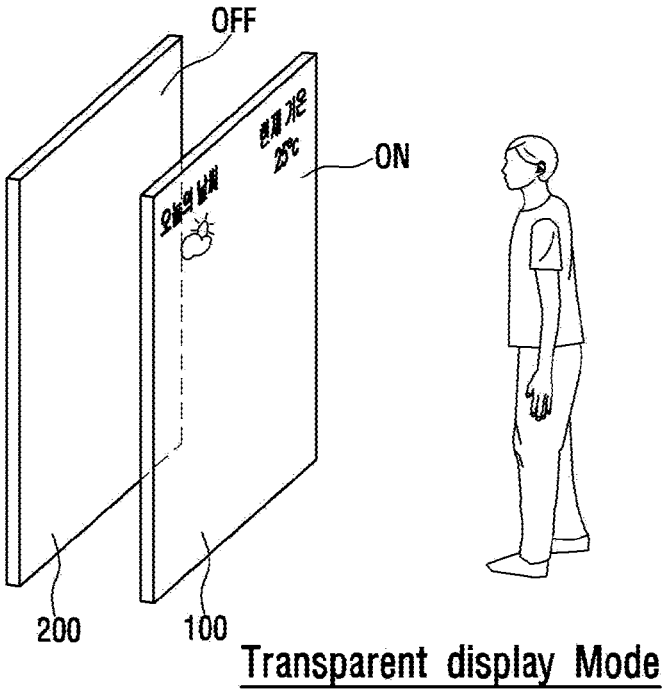
FIG. 9*b* shows a second operation mode of the display apparatus according to the embodiment of the present invention.

FIG. 9*b* shows that the display apparatus according to the embodiment of the present invention operates in the transparent display mode. In FIG. 9*b*, the blind panel 200 is in an off-state, while the display panel 100 is in an on-state. Since the display panel 100 is in an on-state, the display panel 100 emits light by itself and displays the information. However, since the blind panel 200 is in an off-state, the blind panel 200 exists as a transparent panel. In the transparent display mode according to the embodiment of FIG. 9*b*, the user is able to see the information displayed on the display panel 100 while viewing background behind the display apparatus.

Meanwhile, in FIG. 9*b*, not only the micro shutter cells 210 of the blind panel 200 may be all in an off-state, but also only specific micro shutter cells 210 may be in an off-state. In other words, through the selective drive of the blind panel 200, it is possible to control that the on-state of the micro shutter cell 210 is maintained in some area of the blind panel 200 and the off-state of the micro shutter cell 210 is maintained in other areas of the blind panel 200.

In this case, backlight is blocked by the area where the micro shutter cell 210 maintains the on-state, and only the corresponding area can improve the efficiency and visibility of the display panel 100.

Figure 9C:
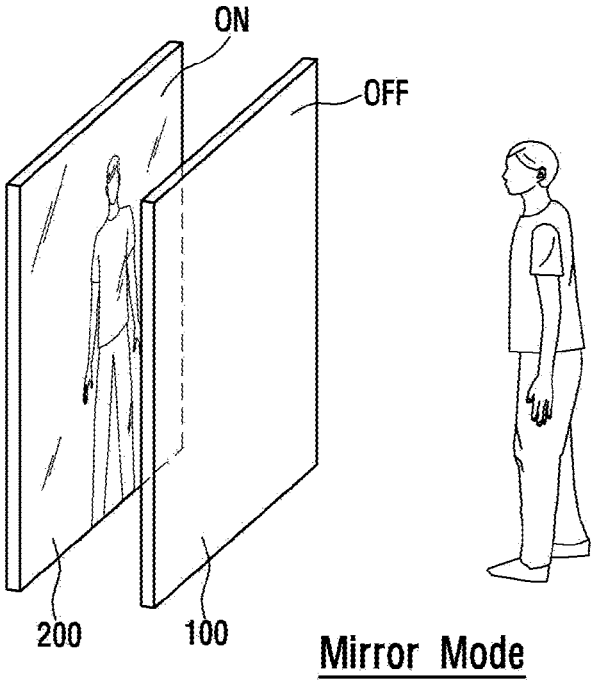
FIG. 9*c* shows a third operation mode of the display apparatus according to the embodiment of the present invention.

FIG. 9*c* shows that the display apparatus according to the embodiment of the present invention operates in the mirror mode. In FIG. 9*c*, the blind panel 200 is in an on-state, while the display panel 100 is in an off-state. Since the display panel 100 is in an off-state, the display panel 100 does not display any information and does not emit light. Therefore, the display panel 100 exists as a transparent panel. However, since the blind panel 200 is in an on-state, that is to say, all of the micro shutter cells 210 are arranged in a direction parallel with the display panel 100, the blind panel 200 exists as one metal plate. Therefore, the blind panel 200 is able to function as a mirror, and the user is able to see his/her figure reflected on the display apparatus in the mirror mode.

In the meantime, only the micro shutter cells 210 included in some area of the blind panel 200 can maintain the on-state. In this case, only the some area is able to functions as a mirror.

Figure 9D:
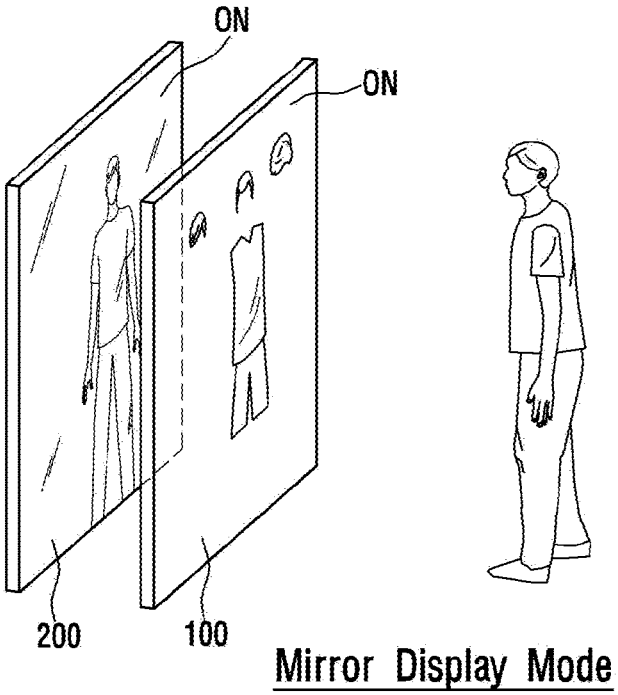
FIG. 9*d* shows a fourth operation mode of the display apparatus according to the embodiment of the present invention.

FIG. 9*d* shows that the display apparatus according to the embodiment of the present invention operates in the mirror display mode. In FIG. 9*a*, the display panel 100 and the blind panel 200 are all in an on-state. Since the display panel 100 is in an on-state, the display panel 100 emits light by itself and displays the information. At the same time, since the blind panel 200 is also in an off-state, the blind panel 200 has a mirror function. Eventually, the user is able to not only check the information displayed on the transparent display panel 100 but also see his/her figure reflected on the blind panel 200.

Meanwhile, in FIG. 9*d*, not only the micro shutter cells 210 of the blind panel 200 may be all in an on-state, but also only specific micro shutter cells 210 may be in an on-state. In other words, through the selective drive of the blind panel 200, the on-state of the micro shutter cell 210 is maintained in some area of the blind panel 200 and the off-state of the micro shutter cell 210 is maintained in other areas of the blind panel 200. Then, backlight is blocked only by the area where the micro shutter cell 210 maintains the on-state, so that the efficiency of the display panel 100 can be improved. Eventually, the on/off is controlled by selecting the area of the blind panel 200, which corresponds to a specific area of the display panel 100, so that the efficiency and visibility of only the selected area can be improved.

The display apparatus according to the embodiment of the present invention is a transparent display apparatus using the OLED. The display apparatus is able to operate without the external environmental constraints and to operate in various modes including the display function.

Although embodiments of the present invention were described above, these are just examples and do not limit the present invention. Further, the present invention may be changed and modified in various ways, without departing from the essential features of the present invention, by those skilled in the art. For example, the components described in detail in the embodiments of the present invention may be modified. Further, differences due to the modification and application should be construed as being included in the scope and spirit of the present invention, which is described in the accompanying claims.

What is claimed is:

1. A display apparatus comprising:

a transparent display panel comprising an organic light emitting diode (OLED) panel that comprises a cathode layer, an organic matter layer, an anode layer, and a thin film transistor (TFT) backplane;

a blind panel which is disposed adjacent to the TFT backplane of the (OLED) panel and comprises a plurality of cells that are individually drivable; and a controller configured to change an operation mode of the display apparatus by selectively turning on and off the transparent display panel and selectively turning on and off at least one cell of the plurality of cells of the blind panel, wherein the at least one cell comprises:

a body configured to reflect or block light; and a driving part having a portion that is configured to be movably bent between angles of 0° to 90° thereby control a position of the body between angles of 0° to 90°.

2. The display apparatus of claim 1, wherein the body comprises a first body extending in a first direction and a second body extending and protruding from the first body in a second direction perpendicular to the first direction, and wherein the second direction is a longitudinal direction in which the driving part extends.

3. The display apparatus of claim 1, wherein the body comprises a first body extending in a first direction and a second body more extending and protruding from the first body in the first direction, and wherein the second body is non-overlapped with the driving part of another adjacent cell.

4. The display apparatus of claim 1, wherein the body has a hexagonal structure and the driving part is connected to a vertex of the hexagonal structure.

5. The display apparatus of claim 1, wherein the body comprises a first body extending in a first direction and a second body extending and protruding in a second direction perpendicular to the first direction, and wherein the second body extends and protrudes from a position opposing a position to which the driving part is connected in the first body.

6. The display apparatus of claim 1, wherein the plurality of the cells are arrayed in an M×N matrix (where M and N are natural numbers).

7. The display apparatus of claim 1, wherein the body of the plurality of the cells is composed of a metal plate.

8. The display apparatus of claim 1, wherein the operation mode comprises at least one of a window mode, a transparent display mode, a mirror mode, or a mirror display mode.

9. The display apparatus of claim 8, wherein the controller is configured to cause the transparent display panel to be turned off and to cause a part of or an entirety of the plurality of the cells of the blind panel to be turned off, so that the display apparatus is operated in the window mode.

10. The display apparatus of claim 8, wherein the controller is configured to cause the transparent display panel to be turned on and to cause a part of or an entirety of the plurality of the cells of the blind panel to be turned off, so that the display apparatus is operated in the transparent display mode.

11. The display apparatus of claim 8, wherein the controller is configured to cause the transparent display panel to be turned off and to cause a part of or an entirety of the plurality of the cells of the blind panel to be turned on, so that the display apparatus is operated in the mirror mode.

12. The display apparatus of claim 8, wherein the controller is configured to cause the transparent display panel to be turned on and to cause a part of or an entirety of the plurality of the cells of the blind panel to be turned on, so that the display apparatus is operated in the mirror display mode.

13. The display apparatus of claim 1, wherein the portion is movably bent by generating heat in the driving part.

14. The display apparatus of claim 1, wherein the portion is movably bent by thermal expansion occurring in the driving part.

15. The display apparatus of claim 1, wherein the portion is movably bent by applying a current to the driving part.

* * * * *